US009874003B1

(12) United States Patent
Humphreys, III

(10) Patent No.: US 9,874,003 B1
(45) Date of Patent: Jan. 23, 2018

(54) METHOD AND APPARATUS FOR CYCLING OR DRAWING DOWN WATER STORED IN PRESSURE TANKS INSTALLED ON WATER SERVICE LINES SUPPLIED BY WATER SUPPLY SYSTEMS

(71) Applicant: Hugh Humphreys, III, Tucson, AZ (US)

(72) Inventor: Hugh Humphreys, III, Tucson, AZ (US)

( * ) Notice: Subject to any disclaimer, the term of this patent is extended or adjusted under 35 U.S.C. 154(b) by 0 days.

(21) Appl. No.: 15/406,686

(22) Filed: Jan. 14, 2017

Related U.S. Application Data

(60) Provisional application No. 62/280,013, filed on Jan. 18, 2016.

(51) Int. Cl.
*E03B 7/00* (2006.01)
*E03B 1/04* (2006.01)
*E03B 5/02* (2006.01)

(52) U.S. Cl.
CPC ..... *E03B 7/006* (2013.01); *E03B 1/04* (2013.01); *E03B 5/025* (2013.01)

(58) Field of Classification Search
CPC ..... E03B 7/006; E03B 11/02; E03B 11/10
USPC ..... 137/12, 208, 209, 357, 587
See application file for complete search history.

(56) References Cited

U.S. PATENT DOCUMENTS 3,346,014 A * 10/1967 Jacuzzi ..... E03B 5/00 137/565.34
4,718,452 A * 1/1988 Maitland ..... F03B 13/00 137/587
4,922,943 A * 5/1990 Gill ..... E03B 1/048 137/1
5,975,133 A * 11/1999 Nalewajski ..... E03B 11/02 137/587
5,988,984 A * 11/1999 Austin ..... F04B 49/02 417/44.2
6,557,819 B2 * 5/2003 Austin ..... E03B 5/02 137/601.13
6,971,399 B2 * 12/2005 Cowan ..... E03B 1/00 137/209
9,097,357 B2 * 8/2015 Humphreys, III ..... E03B 11/10

* cited by examiner

*Primary Examiner* — Reinaldo Sanchez-Medina

(57) ABSTRACT

This method and apparatus relates to water supply demand challenges related to available water reserves caused by seasonal and diurnal peak water demand, emergency water demand such as firefighting efforts and service or supply interruptions for municipal or rural water systems, while also reducing incidence of stagnation in connected pressure tank(s); and more particularly to a water storage apparatus that uses one cycle valve, at least one pressure tank and at least one check valve connected to water service lines that are connected to water mainlines that are connected to municipal or rural water systems. This method and apparatus can reduce water system peak demand challenges and automatically cycle or draw down pressure tanks, while storing regularly refreshed water for use by the water user or customer during service or supply interruptions; commonly called emergency water storage.

2 Claims, 3 Drawing Sheets

Figure 1:
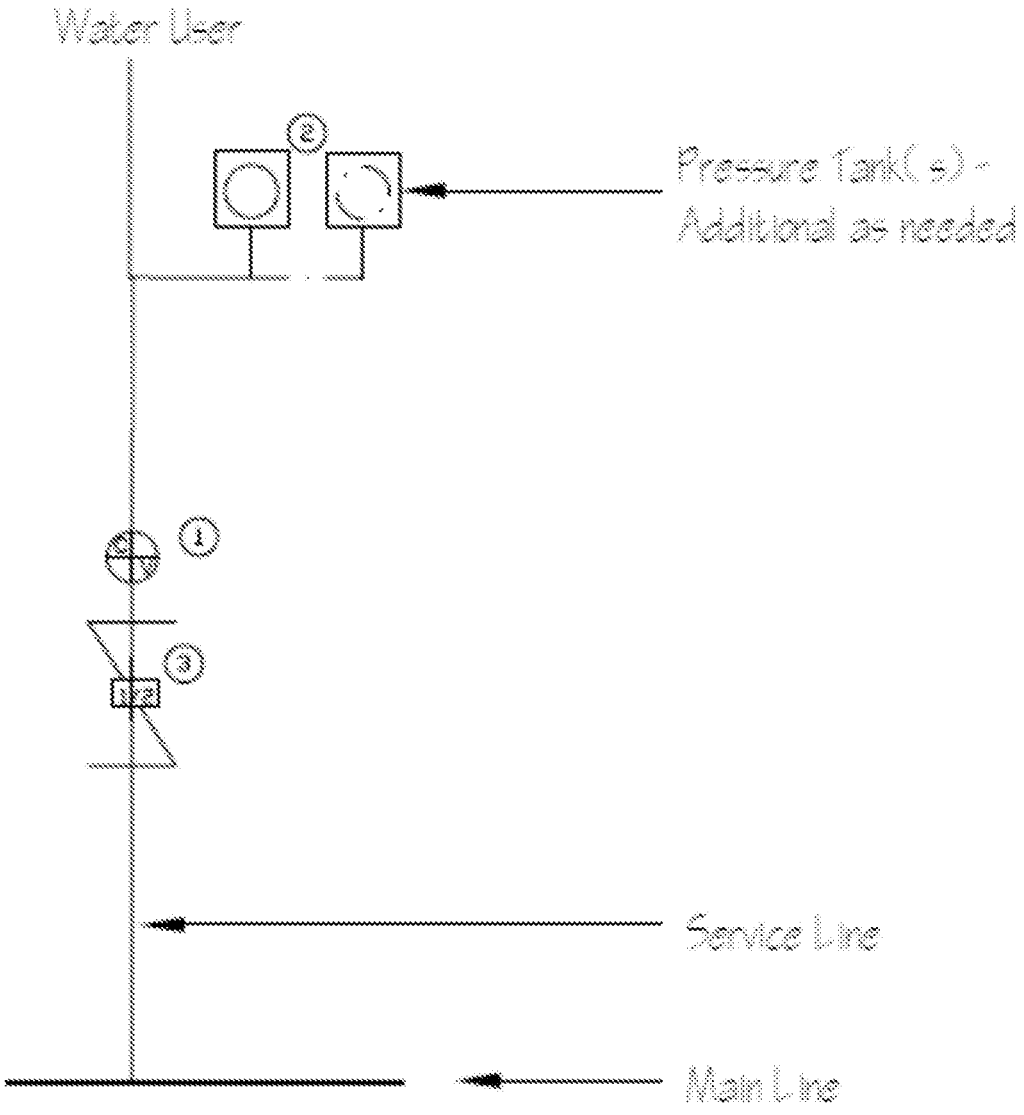

METHOD AND APPARATUS FOR CYCLING OR DRAWING DOWN WATER STORED IN PRESSURE TANKS INSTALLED ON WATER SERVICE LINES SUPPLIED BY WATER SUPPLY SYSTEMS

CROSS-REFERENCED TO RELATED APPLICATIONS

This application claims the benefit of provisional patent application No. 62/280,013 filed 2016, Jan. 18 by the present inventor, which is incorporated by reference.

BACKGROUND

Prior Art

Pressure tanks installed on water system-service lines that supply water to individual water users or customers, using cycle valves to regularly cycle and draw down said pressure tanks to my knowledge has never been exploited heretofore by others.

It is recognized that each of the components utilized in the present invention is conventional; nevertheless, the combination of such components in the present apparatus and the method taught herein are neither disclosed nor suggested by the prior art.

The following is a tabulation of some prior art that presently appears relevant:

| U.S. Pat. No. | U.S Class | Issue Date | Patentee |
|---|---|---|---|
| 4,718,452 | 137/592 | Jan. 12, 1988 | Maitland |
| 3,346,014 | 137/209 | Oct. 10, 1967 | Jacuzzi |
| U.S. 9,097,357 B2 | 137/1, 137/512 | Aug. 4, 2015 | Humphreys |
| 5,988,984 | 417/44.2; 417/53 | Nov. 23, 1999 | Austin |
| U.S. 6,276,658 B1 | 251/28, 251/117 | Sep. 21, 2001 | Austin |
| U.S. 6,557,819 B2 | F16K7/17 | 37,747 | Austin |

U.S. Pat. No. 4,718,452 emergency potable water storage, Douglas W. Maitland, Jan. 12, 1988, utilizes a pressure tank connected to a hose bib with no provision to automatically cycle or draw down the pressure tank.

Prior art for pressure tanks typically indicates their use combined with pumps. For example, U.S. Pat. No. 3,346,014 Pressure tank assembly for water pressure system, Candido Jacuzzi Oct. 10, 1967.

One Patent, U.S. Pat. No. 9,097,357 B2 water storage reserve and return method and apparatus, Hugh Humphreys, Aug. 4, 2015, utilizes pressure tanks installed on water service lines supplied by municipal or rural water systems; however it does not mention or teach the method of using cycle valves to cycle or draw down pressure tanks.

This new method and apparatus addresses stagnation and the need to cycle or draw down pressure tanks in order to store and deliver fresh water to water users. This new method and apparatus can also mitigate water system peak demand challenges by creating individual pressurized, decentralized water storage that is regularly refreshed.

Of particular interest is U.S. Pat. No. 5,988,984 Method and apparatus for liquid control system having a valve with a notch or projection in the seal for enabling a sufficient fluid to pass through when the seal is fully closed to cool the pump and/or motor, Cary M. Austin, teaches how to prevent pump cycling. The description and supporting drawings and claims do not mention or teach the method of using cycle valves plumbed into water service lines connected to water system main lines, without adjacent pump or pressure switch, to cycle or draw down pressure tanks. In fact, following the heading "Background of the Invention" the opening paragraph states: "This invention relates to liquid pumps and liquid systems and more particularly to a valve and system to prevent a motor driving a liquid pump from cycling, that is quickly and repeatedly turning off and on. Owners and operators of water systems have ordinary skill in the art of this invention."

And also of particular interest is U.S. Pat. No. 6,276,658 B1 ROLL SEAL CONTROL VALVE, Cary M. Austin, teaches how to prevent pump cycling. The description and supporting drawings and claims do not mention or teach the method of using cycle valves plumbed into water service lines connected to water system main lines, without adjacent pump or pressure switch, to cycle or draw down pressure tanks. In fact, following the heading "Background of the Invention" the opening paragraph states: "This invention relates to liquid pumps and liquid systems and more particularly to a valve and system to prevent a motor driving a liquid pump from cycling, that is quickly and repeatedly turning off and on. Owners and operators of water systems have ordinary skill in the art of this invention."

U.S. Pat. No. 6,557,819 B2 ROLL SEAL CONTROL VALVE, Cary M. Austin, teaches the same as the two patents above.

In all the last three patents, the description discusses controlling pumps, that may be turned on and off by pressure switches; requiring electricity.

This method and apparatus relies on this type of valve, known as a constant outlet pressure valve; with a notch, projection or bypass, and are well known to the art, and henceforth referred to as a cycle valve. The intent of this new method and apparatus is to cycle or draw down pressure tanks reducing incidence of stagnation while creating individual, decentralized water storage. The last three discussed prior art describe reducing pump cycling.

An exhaustive search of prior art did not reveal a description showing cycle valves installed on individual water service lines, cycling or drawing down pressure tanks to lower incidence of stagnation.

This method and apparatus does not seek to improve cycle valves, pressure tanks or check valves. The method and apparatus described here utilizes cycle valves, pressure tanks and check valves to accomplish the intent of this method and apparatus, which is to cycle or draw down pressure tanks used to store water for water users or customers connected to water service lines, connected to water main lines, connected to municipal or rural water systems. Improvements to cycle valves, pressure tanks and check valves will not affect the intent of the method and apparatus described here. Size or materials of construction for components described do not change the intent for this method and apparatus.

Advantages

Using cycle valves combined with pressure tanks and check valves installed on water service lines, connected to water main lines, connected to municipal or rural water systems, supplying water to individual water users or customers has advantages beyond the obvious. Accordingly the following advantages are apparent.

The apparatus reduces the incidence of stagnation by automatically cycling or drawing down apparatus pressure tank(s), and refills the pressure tank(s) to full water system pressure through the cycle valve notch, projection or bypass.

The apparatus can be used for emergency water storage during water service or supply interruptions; supplying refreshed pressurized water to water users or customers.

Widespread use of the apparatus by individual water users or customers throughout water supply and delivery systems could significantly reduce water demand challenges for water suppliers, water utilities, water purveyors and water users; while lowering costs. The apparatus delays full water flow from the water system while continuing to supply pressurized water to the water user or customer until pressure downstream of the cycle valve falls to a preset pressure and the pressure tank cycles or draws down; creating additional decentralized water storage for water users or customers while also benefiting water systems.

SUMMARY

A method and apparatus for cycling or drawing down water stored in pressure tanks installed on one or more individual water service lines connected to water main lines connected to municipal or rural water systems; without the need for an adjacent pump or pressure switch.

Deterioration in water quality is frequently associated with excessive retention time and aging water. Loss of disinfection residual, formation of disinfection by-products, and bacterial re-growth can all result from aging of water. Turnover of water in pressure tanks during a fill/drawdown cycle is needed to prevent stagnation.

An additional benefit is that during regular operation the apparatus temporarily reduces water flow from the water supply to the water user or customer while continuing to supply full flow, pressurized water to the water user or customer; essentially reducing water peak demand challenges by creating individual, decentralized water storage.

Figure 2:
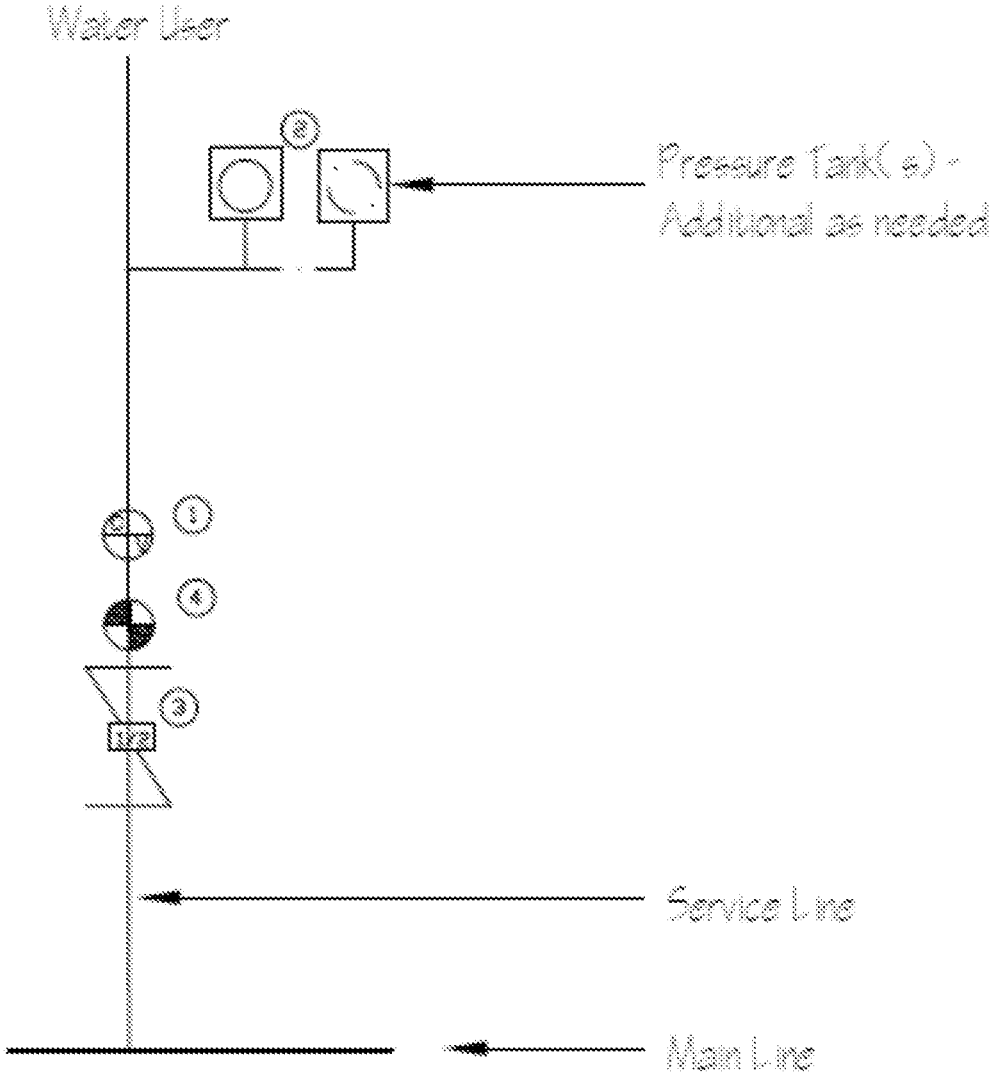
Figure 3:
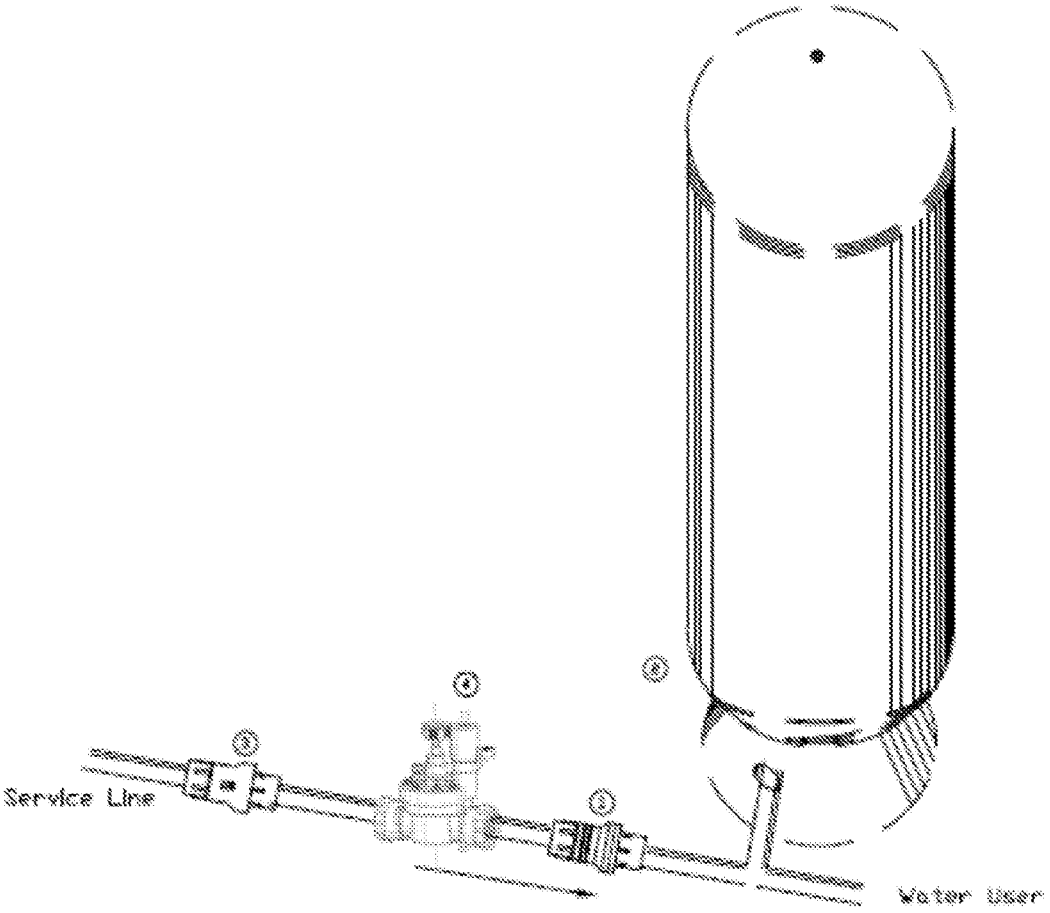

The embodiments—FIG. 2 and FIG. 3—showing a normally open solenoid/pilot operated diaphragm valve requires electrical power to operate. This option is intended to be operated by a timer or controlled by a water service provider/utility remotely, through smart meter technology or other communication method and used to restrict water delivery to water users or customers. This embodiment is shown to manage peak demand or conservation of water resources. For example; water service providers could use this option to regulate landscape irrigation to certain days or time of day. This option could be used on overburdened municipal water systems that need to regulate or rotate water deliveries to various sectors or areas. The normally open valve is closed upon solenoid activation. Another possible use would to operate this valve by a switch operated by the water user or customer; to be used to turn off water flow to the apparatus for any reason. Benefits include: system off, forcing cycling of the pressure tank(s), or system off for testing the apparatus and or repairs downstream of the valve.

Water utilities, water purveyors, water system operators and water users or customers reap the benefits. Property developers could benefit because water infrastructure development costs may decline as apparatus use increases. This method and apparatus can effectively create individual water user water storage throughout a municipal water system, leading to additional decentralized water storage for municipal or rural water systems. Lowering peak demand challenges. Still further advantages will become apparent from a study of the following description and the accompanying drawings.

DRAWINGS

Figures

FIG. 1—is a diagrammatic view of an embodiment of the apparatus showing a check valve 3, cycle valve 1 and pressure tank 2.

FIG. 2—is a diagrammatic view of an embodiment of the apparatus showing check valve 3, optional normally open diaphragm valve 4, cycle valve 1 and pressure tank 2.

FIG. 3—is a perspective view of an embodiment of the apparatus showing check valve 3, optional normally open diaphragm valve 4, cycle valve 1 and pressure tank 2.

DETAILED DESCRIPTION

Referring to FIG. 1 for details of an embodiment of this method and apparatus the same comprises cycle valve 1 installed inline on the water service line. Direction of flow, toward the water user. Pressure tank 2 is installed on a tee connection downstream of cycle valve 1, between cycle valve 1 and the water user. Check valve 3 is installed on the service line before cycle valve 1, between main line and cycle valve 1. Direction of flow, toward the water user. The apparatus is installed in the water service line using appropriate materials.

Operation:

The cycle valve in this embodiment operates entirely on water system supplied water and pressure. No adjacent pump is required; for example, water and pressure could be supplied by a piped water system originating from an elevated water source or elevated tank. No connected power is required for operation. Water flow through the notch, projection or bypass in cycle valve 1 equalizes pressure on both sides of cycle valve 1 by filling pressure tank 2. Water supplied by service line and main line. When water is used by the water user, water delivery/flow from water supply is substantially reduced, until water discharged from the pressure tank 1 lowers pressure downstream of the cycle valve to a preset pressure; discharging a portion of the pressurized water stored in the pressure tank; delivering stored water to the water user or customer. The pressure tank is refilled and fully charged, and pressure on both sides—inlet and outlet—of the cycle valve is equalized, by water flowing through the cycle valve notch, projection or bypass when there is low or no water user demand. While operating at or below the preset pressure point the cycle valve allows full flow; for example preset pressure of 50 psi. When pressure falls below preset pressure the cycle valve is fully open. At no time is the water user without water, unless water system fails to deliver water. If water system fails to supply water, water stored in the pressure tank is available for use until exhausted. Check valve 3 prevents backflow and reserves stored water for delivery to the water user.

Referring to FIG. 2 for details of an embodiment of this method and apparatus the same comprises normally open pilot/solenoid operated, diaphragm valve 4 installed between cycle valve 1 and check valve 3, all three are installed inline on the water service line. Direction of flow toward the water user. Pressure tank 2 is installed on a tee connection downstream of the cycle valve 1, between cycle valve 1 and the water user. The apparatus is installed in the water service line using appropriate materials.

Operation:

Electricity is needed when using optional, additional, normally open, pilot/solenoid operated, diaphragm valve embodiment. This embodiment is available to further manage peak demand or conservation of water resources. The valve is normally open, requiring power to close. This option is intended to be operated by a timer or controlled by a water service provider/utility remotely, through smart meter technology or other communication method; used to restrict water delivery to water users or customers during peak demand, low pressure situations such as fire fighting efforts or water conservation enforcement. For example; water service providers could use this option to regulate landscape irrigation to certain days or time of day. This option could be used on overburdened water systems that need to regulate or rotate water deliveries to various sectors or areas. Another use would be a switch installed as a convenience for use by the water user or customer to turn the valve off for testing the apparatus, cycling the pressure tank(s) or repairs downstream. In all other respects the apparatus performs as described by operation for FIG. 1.

I claim:

1. A method for mitigating water stagnation in pressure tanks installed on water service lines comprising: a. providing a water flow control apparatus comprising: i. at least one pressure tank for storing water; ii. a cycle valve for controlling water flow from a water service line to a water user line and to a pressure tank line; iii. a check valve for controlling water flow from water service line to a water supply; wherein the water flow control apparatus is free of electrical connections; b. delivering water from the water service line to the water user line; c. delivering water from the pressure tank to the water user line when a water user line pressure is below a critical pressure and a water service line pressure is near or at the critical pressure; d. delivering water from the pressure tank to the water service line when the water service line pressure is less than a pressure tank pressure; and e. refilling the pressure tank, through a notch, projection or bypass in the cycle valve, with water from the water service line when the pressure tank pressure is relatively lower than the water service line pressure; wherein the check valve automatically opens and closes due to pressure differences between the water service line and the water user line and the pressure tank line.

2. A method for mitigating water stagnation in pressure tanks installed on water service lines consisting of: a. providing a water flow control apparatus comprising: i. at least one pressure tank for storing water; ii. A cycle valve for controlling water flow from a water service line to a water user line and to a pressure tank line; iii. A check valve for controlling water flow from water service line to a water supply; wherein the water flow control apparatus is free of electrical connections; b. delivering water from the water service line to the water user line; c. delivering water from the pressure tank to the water user line when a water user line pressure is below a critical pressure and a water service line pressure is near or at the critical pressure; d. delivering water from the pressure tank to the water service line when the water service line pressure is less than a pressure tank pressure; and e. refilling the pressure tank, through a notch, projection or bypass in the cycle valve, with water from the water service line when the pressure tank pressure is relatively lower than the water service line pressure; wherein the check valve automatically opens and closes due to pressure differences between the water service line and the water user line and the pressure tank line.

* * * * *